313-414 SR
7/6/82 XR 4,338,541

United States Patent [19]
Beck
[11] 4,338,541
[45] Jul. 6, 1982

[54] MULTIPLE BEAM CATHODE RAY TUBE HAVING REDUCED OFF-AXIS ABERRATIONS

[75] Inventor: Vernon D. Beck, Ridgefield, Conn.

[73] Assignee: International Business Machines Corporation, Armonk, N.Y.

[21] Appl. No.: 101,338

[22] Filed: Dec. 7, 1979

[51] Int. Cl.[3] ..... H01J 29/51; H01J 29/56

[52] U.S. Cl. ..... 313/411; 313/412; 313/413; 313/414

[58] Field of Search ..... 313/411, 414, 412, 413, 313/409

[56] References Cited

U.S. PATENT DOCUMENTS

| | | | |
|---|---|---|---|
| 2,581,243 | 1/1952 | Dodds | 313/338 |
| 2,721,287 | 10/1955 | Van Ormer | 313/409 |
| 2,776,389 | 1/1957 | Peter . | |
| 2,862,144 | 11/1958 | McNaney . | |
| 3,090,884 | 5/1963 | Morse | 313/256 |
| 3,514,663 | 5/1970 | Yoshida et al. | 315/13 |
| 3,633,065 | 1/1972 | Compton et al. . | |
| 3,639,796 | 2/1972 | Fuse | 313/411 |
| 3,742,276 | 6/1973 | Gumpertz . | |
| 3,778,659 | 12/1973 | Houston . | |
| 3,798,478 | 3/1974 | Say | 313/411 |
| 3,843,902 | 10/1974 | Miram et al. | 313/454 |
| 3,927,341 | 12/1975 | Hughes | 313/412 |
| 4,119,883 | 10/1978 | Miyaoka | 313/414 |

FOREIGN PATENT DOCUMENTS

| | | |
|---|---|---|
| 1816130 | 4/1971 | Fed. Rep. of Germany . |
| 1290387 | 9/1972 | United Kingdom . |

*Primary Examiner*—Palmer C. Demeo
*Attorney, Agent, or Firm*—Pollock, Vande Sande & Priddy

[57] ABSTRACT

A multiple beam cathode ray tube having diminished off-axis aberrations and a reduced length. A tube having a flat or planar electron beam emitter means, focussing means and deflection means is provided. A novel accelerating means is provided for accelerating the emitted beams while causing them to converge towards a cross-over point which is located not closer to the screen of the tube than the deflection means. The maximum off-axis distance of the beams when traversing the focussing and deflection means is reduced, and the off-axis aberrations are correspondingly diminished.

12 Claims, 4 Drawing Figures

MULTIPLE BEAM CATHODE RAY TUBE HAVING REDUCED OFF-AXIS ABERRATIONS

FIELD OF THE INVENTION

The present invention is directed to improvements in multiple beam cathode ray tubes, and more particularly is directed to a multiple beam cathode ray tube having reduced off-axis aberrations.

BACKGROUND OF THE INVENTION

Multiple beam cathode ray tubes are frequently used to display alphanumeric and/or other visual pattern information. Such tubes have greater bandwidth than single beam tubes, which enables them to display more information at suitable brightness than the single beam type.

Typically, the multiple beam tubes utilize a plurality of closely spaced electron beams which are arranged in a vertical column array. Accelerating means, focussing means and deflection means are disposed in or on the envelope of the cathode ray tube, and after being accelerated and focussed, the beams are deflected across the screen while repeatedly being turned on and off so as to form "dots" on the screen at respective scanning positions. In order to form the desired characters or other patterns, logic circuitry selectively controls each beam to be either on or off at each scanning position, and the resulting arrangement of "dots" forms the desired pattern.

One problem which has been encountered with multiple beam cathode ray tubes is the presence of off-axis aberrations. Since only one beam can be emitted along the axis of the tube, the remainder of the beams in a multiple beam tube are off-axis by varying amounts. The abberrations are caused by off-axis imperfections in the focussing and deflection fields, and the imperfections, and therefore, the aberrations, increase with distance from the axis.

In the conventional multiple beam tubes, the beams are emitted parallel to the axis and are accelerated in the same direction to the focussing means or lens, which changes the direction of the beams and causes them to converge towards a crossover point which is located in the funnel portion of the tube.

In accordance with this arrangement, the parallel beams are spaced from each other by a substantial distance, resulting in a relatively large maximum off-axis distance as the beams traverse the focussing means, and due to the fact that the beams do not cross until they are well into the funnel, a relatively large maximum off-axis distance again results as the converging beams traverse the deflection means. Actually, the magnetic deflection yoke is the component which introduces the largest aberration, and the distortion is most severe when a preferred large deflection angle, which permits the length of the tube to be minimized for a given screen size, is employed. The off-axis aberrations caused by the conventional components and arrangement described above prevent the beams from being focussed to desired locations on the screen, and have proven to be quite troublesome.

A possible expedient for reducing the maximum off-axis distance as the beams traverse the focussing and deflection means is the use of an additional lens. However, such an arrangement would necessarily increase the overall length of the cathode ray tube and thus is not desirable.

An approach disclosed in the prior art is the use of a curved cathode for emitting initially converging beams which may cross each other at a point near the deflection means. For example, Houston U.S. Pat. No. 3,778,659 and Miram et al. U.S. Pat. No. 3,843,902 show curved cathodes which emit converging electron beams. The problem with this approach is that curved cathodes are difficult to manufacture, and may increase the manufacturing and selling cost of the tubes.

SUMMARY OF THE INVENTION

It is therefore an object of the invention to provide a multiple beam cathode ray tube which has reduced off-axis aberrations.

It is a further object of the invention to provide a multiple beam cathode ray tube having a reduced length.

It is still a further object of the invention to provide a multiple beam cathode ray tube which achieves the above objects while utilizing a flat or planar cathode.

It is still a further object of the invention to provide an improved acceleration means for a multiple beam cathode ray tube.

The above objects are accomplished by providing a multiple beam cathode ray tube having a longitudinal axis and having a flat or planar cathode for initially emitting a plurality of electron beams parallel to the axis. Conventional focussing means and deflection means are provided for focussing and deflecting the beams in the usual manner.

In accordance with the invention, a novel accelerating means is disposed between the cathode and the deflection means for accelerating the electron beams while simultaneously changing their direction and causing them to converge to a beam crossover point which is located not closer to the screen than the deflection means.

The converging electron beams as well as the beams which diverge immediately after the crossover point are closer to each other and to the axis of the tube then the parallel beams which are initially emitted by the cathode. Hence as the beams traverse the focussing and deflection elements, the maximum off-axis distance is less than in the conventional parallel-beam arrangement described above. Thus, the off-axis aberrations which the beams experience are reduced and the degree of success with which the beams can be focussed to a desired point on the screen is correspondingly increased. At the same time since the beams converge earlier in their respective paths then in the conventional multiple beam tube, the overall length of the tube is decreased.

The accelerating means provides an electric field which is initially constant, and which then increases up to a maximum value to effect the convergence of the beams and then decreases to zero at the accelerating means exit.

In the preferred embodiment the accelerating means is comprised of an anode and a field shaping electrode which face each other. The anode is in the shape of a figure of revolution which is generated by rotating a curved line which is convex in the direction facing the cathode about the axis of the tube, and further has a centrally located exit aperture which bounds an area which includes the axis. The field shaping electrode has a radially exterior portion in the shape of a figure of revolution which is generated by rotating a curved line which is convex in the direction facing the anode around the axis, and further has a planar radially interior portion having apertures therein, and which serves as a grid.

BRIEF DESCRIPTION OF THE DRAWINGS

The invention will be better understood by referring to the following drawings, in which.

DESCRIPTION OF THE PREFERRED EMBODIMENTS

Figure 1:
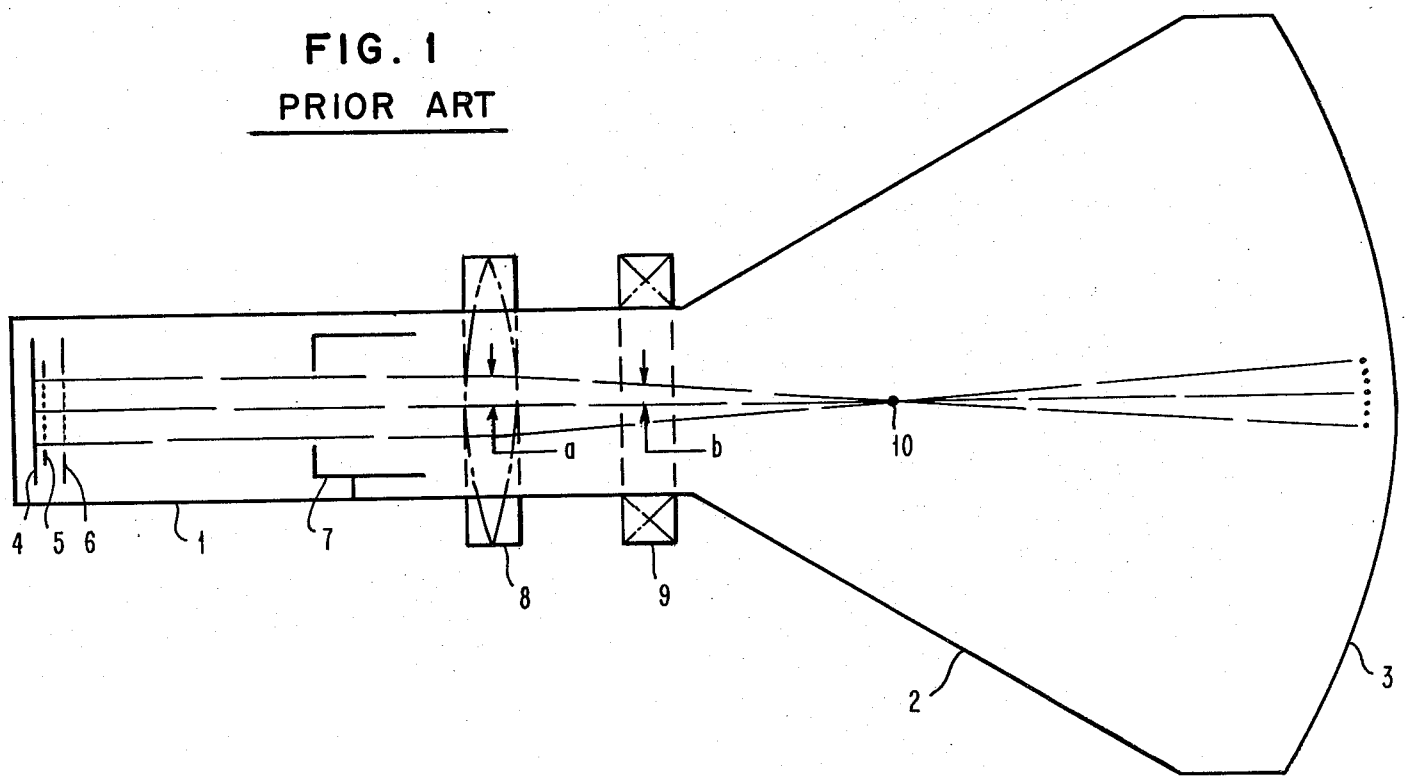
FIG. 1 PRIOR ART
FIG. 1 is a schematic representation of a conventional multiple beam cathode ray tube.

Referring to FIG. 1, a typical multiple beam cathode ray tube according to the prior art is shown. The tube envelope is comprised of neck portion 1, funnel portion 2, and screen 3. The cathode 4, control grid 5, shielding grid 6, and accelerating means 7, are disposed in the neck of the tube, while focussing means 8, and deflection means 9, are disposed around the neck. It should be understood that all of the components illustrated in FIG. 1 are conventional and that, while magnetic focussing and deflection means are shown, if desired, electrostatic means may be used instead.

In the operation of the tube, sheet cathode 4, when heated, emits electrons across its entire surface. Control grid array 5 is typically comprised of a plurality of planar elements, each having a circular aperture, which defines and passes an electron beam. Shielding grid 6 may be comprised of a unitary planar element having a plurality of apertures which correspond in position to the apertures of control grid array 5, for permitting passage of the electron beams.

The parallel electron beams are accelerated by accelerating means 7, which is maintained at a high potential relative to the cathode and grids. After being accelerated, the beams are focussed on the screen by focussing means 8, and are deflected thereacross by deflection means 9. As will be seen in FIG. 1, the focussing means causes the incoming parallel beams to converge towards crossover point 10, which is located well into the funnel portion of the tube.

As mentioned above, one problem which is encountered with the conventional multi-beam cathode ray tube described above is that those electron beams which are off-axis experience aberrations, with resulting distortions in the image which is focussed on the screen. Due to the fact that the maximum off-axis distances a and b as the beams traverse the focussing means and deflection means respectively, are substantial, the off-axis aberrations may be quite severe. It is the magnetic deflection yoke which introduces the largest aberrations, which as mentioned above, are most serious when the beam is deflected through a large angle.

Figure 2:
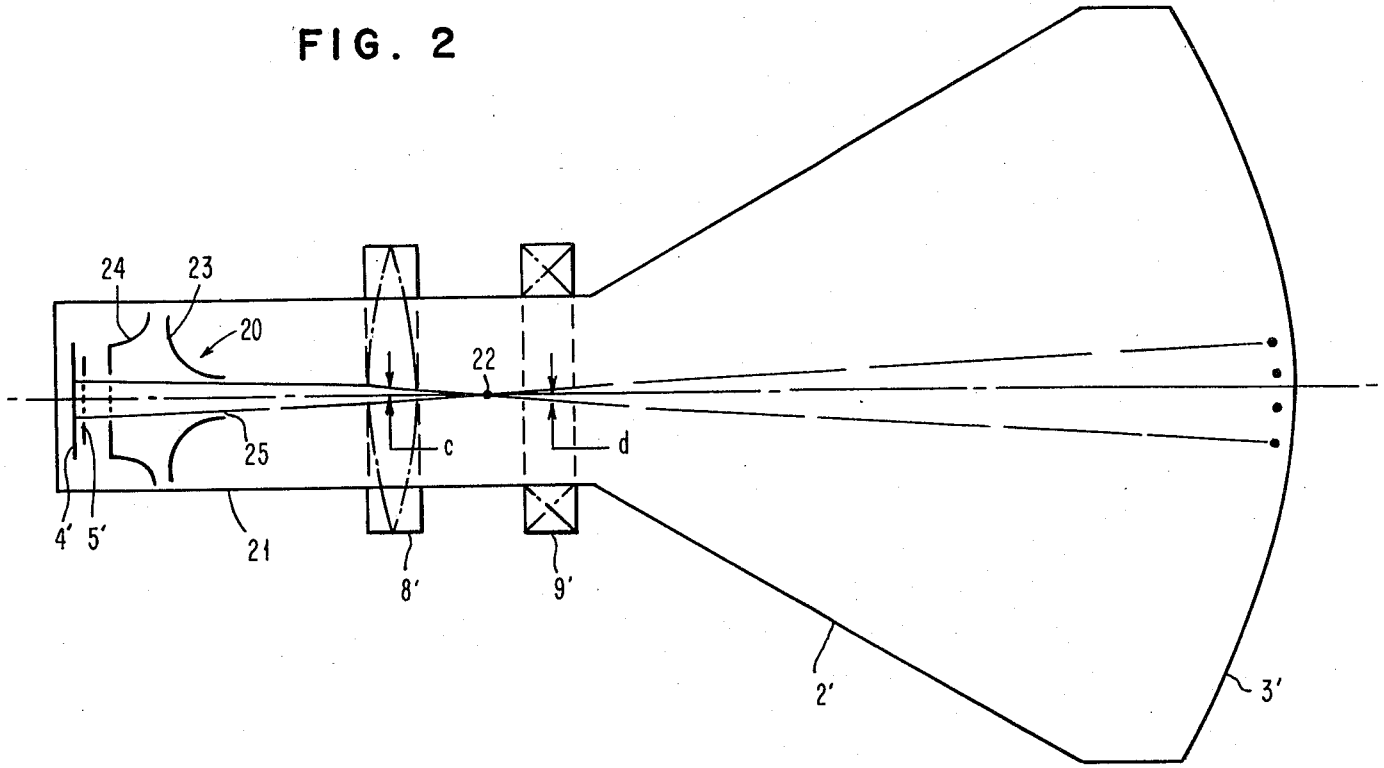
FIG. 2 is a schematic representation of a multiple beam cathode ray tube which incorporates an embodiment of the invention.

The present invention minimizes the off-axis aberrations while shortening the overall length of the tube, and an embodiment of the invention is shown in FIG. 2. In that Figure, like numerals indicate the same components as in FIG. 1, and it is seen that the cathode ray tubes of FIGS. 1 and 2 are similar, except that accelerating means 7 of FIG. 1 is replaced in FIG. 2 by novel accelerating means 20, and that neck portion 21 of the tube of FIG. 2 is shorter than neck portion 1 of the prior art tube. The accelerating means of the invention is effective to accelerate the beams while simultaneously changing their direction, causing them to converge towards beam intersection point 22, which is located not further towards the screen of the tube than the deflection means. As shown in FIG. 2, this causes the maximum off-axis distances c and d of the beams as they traverse the focussing means and the deflection means repectively to be substantially smaller than the corresponding off-axis distances a and b of the prior art arrangement. At the same time causing the beams to converge closer to the cathode allows the length of the neck portion of the tube to be shortened.

Figure 3:
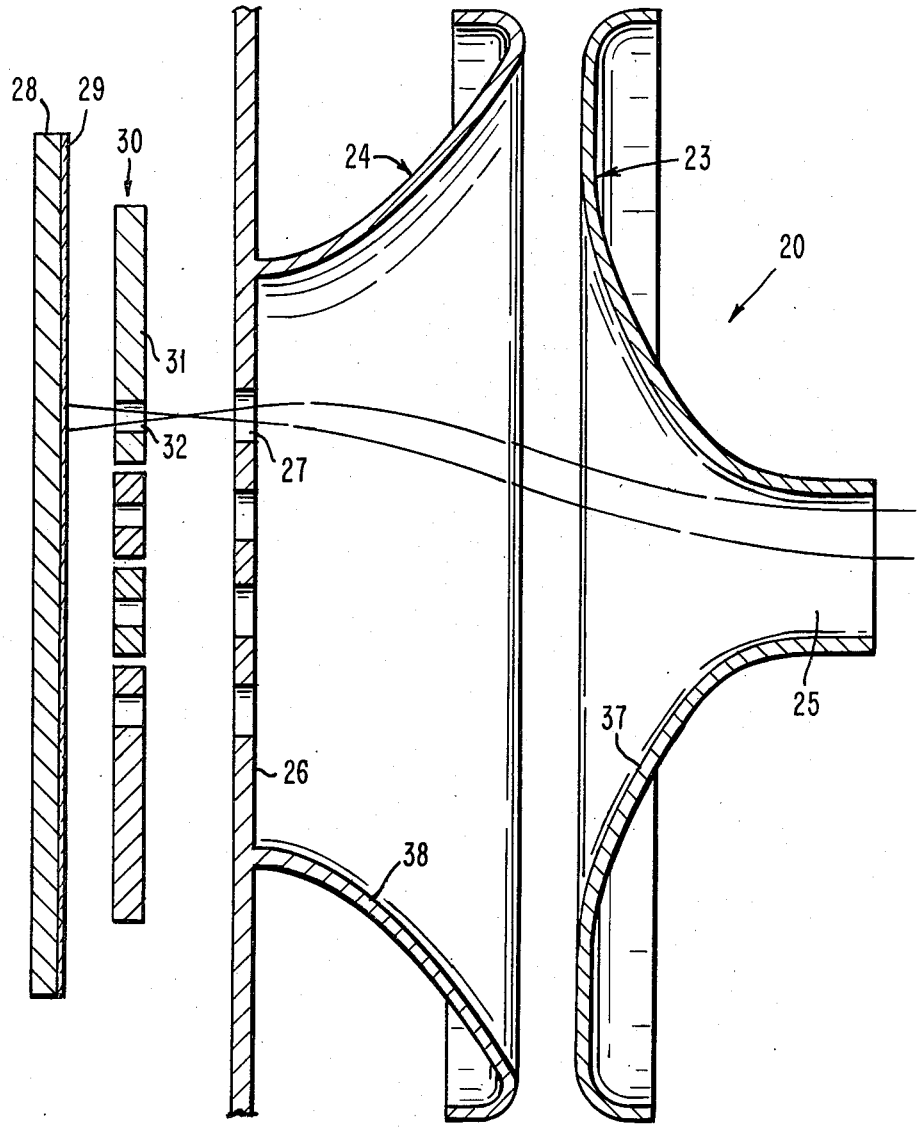
FIG. 3 is a cross-sectional view of an embodiment of the novel accelerating means of the invention.

An embodiment of accelerating means 20, is comprised of the combination of anode 23 and field shaping electrode 24, which are shown in greater detail in FIG. 3. Referring to that Figure, it will be seen that the anode and field shaping electrode are in the shape of curved figures of revolution, which face each other. Surface 37 of anode 23 is a surface of revolution which is generated by rotating a curved line which is convex in the direction facing the cathode around the axis of the tube, and additionally has a centrally located exit aperture 25, which bounds an area which includes the axis. Field shaping electrode 24 is comprised of radially interior planar shielding grid portion 26 and a radially exterior curved figure of revolution portion having field shaping surface 38 which faces the anode and which is formed by rotating a curved line which is convex in the direction facing the anode around the axis of the tube.

In the operation of the accelerating means, anode 23 is maintained at a very high voltage with respect to grids 30 and 26. When the cathode substrate 28 is heated, electrons are emitted from the surface of emitter layer 29, and are formed into beams by the apertures 32 in control grid array 30. The beams so formed are accelerated by the high potential on anode 23, and after passing through the shielding grid apertures 27, which comprise the entrance to the accelerating means structure, are caused to converge as shown in FIG. 3.

Figure 4:
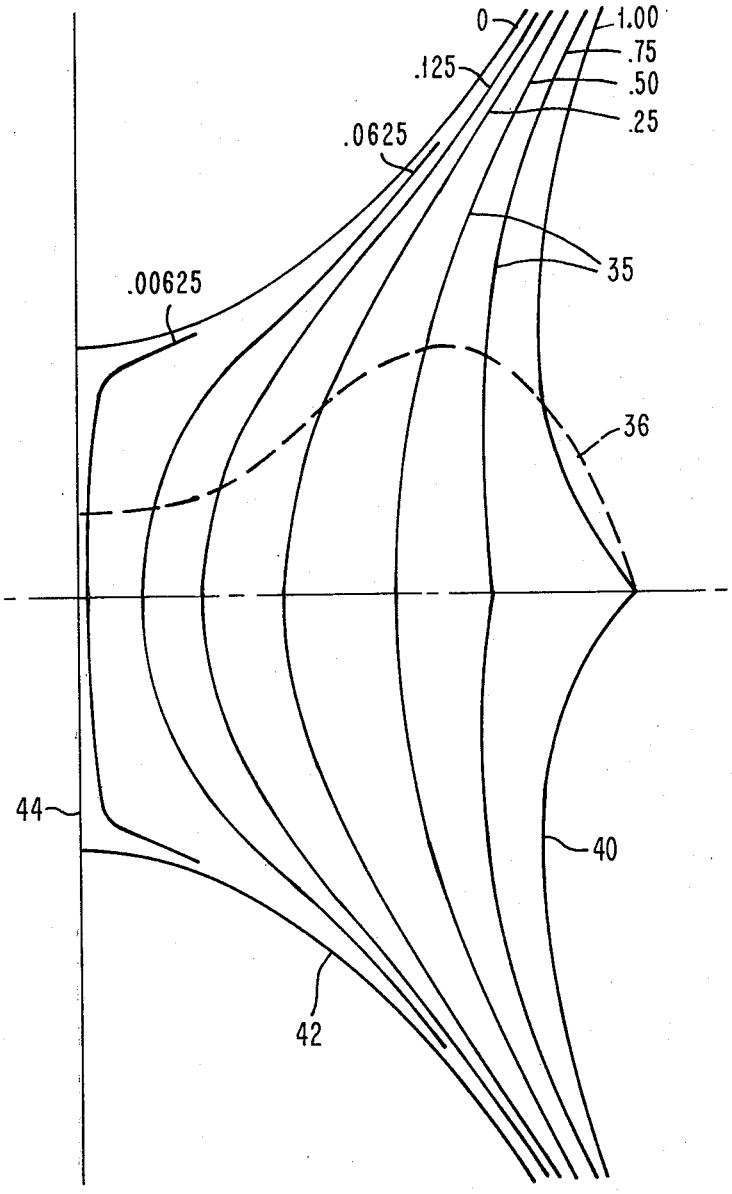
FIG. 4 is a schematic representation of the accelerating means shown in FIG. 3, further showing equipotential lines and a plot of electric field intensity.

The operation of the novel accelerator may be further illuminated by referring to FIG. 4, which is a schematic representation of an accelerator similar to that shown in FIG. 3, with equipotential lines 35, and a plot of the axial electric field intensity 36 superimposed. Referring to field plot 36, it is noted that the electric field at the entrance to the accelerator structure is initially constant, then increases to a maximum value, and then descends to zero at the anode exit. The initially constant field is necessary when a flat cathode is used to maintain the field in conformance with LaPlace's equation. The increasing field causes the electron beams to converge, and it may be observed that the field increases for the greater part of the axial distance inside the accelerator. In order to prevent the discontinuity formed by the exit aperture from causing severe field aberrations, the field is brought to zero at the accelerator exit.

In deriving the shapes for the electrodes shown in FIG. 4, the axial field restraints described above were first postulated, and it was determined that a fourth order polynomial function was the simplest function which conformed thereto. Since in a cylindrical geometry, the potential obeying LaPlace's equation everywhere in the geometry is defined after an axial field is determined, the equipotentials shown in FIG. 4 were derived from the axial field. The electrodes 40 and 42 were chosen respectively, as the equipotential surface having a planar component and the equipotential surface in which the electric field falls to zero.

In the embodiment of FIG. 3, the axial field is approximated with a sixth order polynomial and in this case, a higher order is attained at the exit then in the arrangement of FIG. 4, meaning that a bigger exit aperture may be used. It should be noted that the solution discussed above and illustrated in FIG. 4 may be varied to a small extent by the presence of the exit aperture, and such variation will be minimized when a higher order zero in the axial field is used at the aperture.

Additionally, the location of beam crossover point 22 in FIG. 2 can be adjusted by changing the ratio of the axial field at the entrance to the accelerator to the maximum axial field in the accelerator. In the arrangement depicted in FIG. 4, the maximum axial field is three times the field at the entrance, and the tip of the anode at the exterior of the exit aperture is 2 cm., from the entrance, while the beams cross each other 5.03 cm. beyond the accelerator entrance.

In the embodiment of FIG. 3, illustrative dimensions are 1 inch for the overall diameter of the structure, ½ inch for the diameter of the radially interior planar portion of the field shaping electrode, and 1.15 inches for the length of the structure from the entrance to the tip of the exit aperture. Typical materials which the electrodes may be constructed of are stainless steel and nickel. An exemplary mounting technique is to dispose glass spacer rods between radially extending tabs disposed at the periphery of the structure, and to secure the structure in the neck of the tube with spring clips.

While the actual operating potentials which are applied to the electrodes will differ in individual use of the tubes, by way of example, the anode could be maintained at 16 kv., the field shaping electrode at 200 v., the control grid array at 0 to 50 v., and the cathode at 0 v.

There thus has been described a novel accelerating means for a multiple beam cathode ray tube which results in diminished off-axis aberrations and in a cathode ray tube of reduced length. It should be understood that while I have described a preferred embodiment of the invention, I do not intend to be restricted thereto, but rather intend to cover all variations and modifications which come within the spirit of the invention, which is limited only by the claims which are appended hereto.

What is claimed is:

1. A multiple beam cathode ray tube wherein a plurality of electron beams originated by an electron beam source means cross each other only once in said tube at a crossover point before being incident on said screen, said tube having reduced off-axis aberrations, comprising, a cathode ray tube envelope having a longitudinal axis and having a screen at one end thereof, an electron beam source means disposed in said envelope at the other end thereof for emitting a plurality of electron beams towards said screen, said electron beam source means being comprised of one or more flat or planar elements, focussing means disposed between said electron beam source means and said screen for focussing said plurality of electron beams on said screen, deflection means also disposed between said electron beam source means and said screen for deflecting said plurality of electron beams across said screen, and means disposed between said electron beam source means and said deflection means for accelerating said electron beams while simultaneously causing them to converge towards each other, and to cross each other in their respective paths towards said screen at said single beam crossover point which is located further from the electron beam source end of the tube than the focussing means and not closer to said screen than said deflection means.

2. The cathode ray tube of claim 1 wherein said means for accelerating said electron beams while simultaneously causing them to converge comprises means for providing an electric field which increases in the axial direction away from said electron beam source means.

3. The cathode ray tube of claim 2 wherein said means for accelerating said electron beams while simultaneously causing them to converge further comprises means for providing an electric field which increases in the axial direction away from said electron beam source means up to a maximum field value and then decreases in said direction to a minimum value.

4. The cathode ray tube of claim 3 wherein said means for accelerating said electron beams while simultaneously causing them to converge has an entrance and an exit for said electron beams, and wherein this means provides a constant electric field at its entrance.

5. The cathode ray tube of claim 4 wherein said means for accelerating said beams while simultaneously causing them to converge includes an anode having a surface which is a surface of revolution which is generated by rotating a curved line which is convex in the direction facing said electron beam source means around said axis, and having a centrally located exit aperture which bounds an area which includes said axis.

6. The cathode ray tube of claim 5 wherein during the operation of said tube said anode is maintained at a much higher positive potential than the potential of said electron beam source means, and wherein said minimum field value is zero, and occurs at said centrally located exit aperture.

7. The cathode ray tube of claim 6 wherein said means for accelerating said beams while causing them to converge further includes a field shaping electrode which is disposed closer to said electron beam source means than said anode, at least part of said field shaping electrode having a surface which is a surface of revolution which is generated by rotating a curved line which is convex in the direction facing said anode around said axis, said electrode being maintained at a lower potential than said anode during the operation of said tube.

8. The cathode ray tube of claim 7 wherein part of said field shaping electrode comprises a planar grid means which is disposed interiorly of said surface of revolution of said field shaping electrode with its faces perpendicular to said axis and which includes a plurality of apertures for passage of said electron beams.

9. The cathode ray tube of claim 8 wherein said deflection means is located between said focussing means and said screen and wherein said means for accelerating said beams while causing them to converge causes said beams to converge at a beam crossover point which is located between said focussing means and said deflection means.

10. The cathode ray tube of claim 9 wherein said electron beam source means is comprised of a sheet cathode which emits electrons across its entire surface and a control grid means having apertures for forming said beams, said control grid means being located between said cathode and said planar grid means which comprises a part of said field shaping electrode.

11. The cathode ray tube of claim 10 wherein the shape of said anode resembles the shape of the mouth of a trumpet.

12. The cathode ray tube of claim 11 wherein said surface of said second electrode which is a surface of revolution is smaller in the radial direction of said cathode ray tube than said anode, and lies opposite a radially extending portion of said anode which is spaced from said axis in said radial direction.

* * * * *